US007552711B2

(12) United States Patent
Kaneko

(10) Patent No.: US 7,552,711 B2
(45) Date of Patent: Jun. 30, 2009

(54) INTAKE CONTROL DEVICE FOR VEHICLE ENGINE

(75) Inventor: Masaaki Kaneko, Iwata (JP)

(73) Assignee: Suzuki Kabushiki Kaisha, Hamamatsu-shi (JP)

( * ) Notice: Subject to any disclaimer, the term of this patent is extended or adjusted under 35 U.S.C. 154(b) by 0 days.

(21) Appl. No.: 12/177,457

(22) Filed: Jul. 22, 2008

(65) Prior Publication Data

US 2009/0031986 A1 Feb. 5, 2009

(30) Foreign Application Priority Data

Jul. 30, 2007 (JP) ..... 2007-197041

(51) Int. Cl.
*F02D 9/10* (2006.01)

(52) U.S. Cl. ..... 123/336; 123/337; 123/339.25

(58) Field of Classification Search ..... 123/336, 123/337, 339.14, 339.25
See application file for complete search history.

(56) References Cited

U.S. PATENT DOCUMENTS

| | | | | |
|---|---|---|---|---|
| 7,380,534 | B2 * | 6/2008 | Sekimoto | 123/198 E |
| 2006/0213475 | A1 * | 9/2006 | Sekimoto | 123/184.35 |

FOREIGN PATENT DOCUMENTS

| | | |
|---|---|---|
| JP | 05-180038 | 7/1993 |
| JP | 06-108904 | 4/1994 |
| JP | 06-146940 | 5/1994 |
| JP | 2002-129987 | 5/2002 |

* cited by examiner

*Primary Examiner*—Erick Solis
(74) *Attorney, Agent, or Firm*—Barnes & Thronburg LLP

(57) ABSTRACT

An intake control device for a vehicle engine includes: a throttle body; a main throttle valve configured to be opened or closed in response to an operation applied to a throttle grip, the main throttle valve being rotatably supported by the throttle body; a sub-throttle valve configured to be opened or closed under control of an actuator, the sub-throttle valve being rotatably supported by the throttle body; an intake air path formed in the throttle body and provided with the main throttle valve and the sub-throttle valve so as to open or close the intake air path; and a bypass air path that is different from the intake air path and provided with an idle speed control (ISC) valve that is controlled so as to open or close the bypass air path in conjunction with the sub-throttle valve.

14 Claims, 15 Drawing Sheets

SUB-THROTTLE FULL-CLOSE

SUB-THROTTLE HALF-OPEN

SUB-THROTTLE FULL-OPEN

SUB-THROTTLE FULL-CLOSE

SUB-THROTTLE HALF-OPEN

SUB-THROTTLE FULL-OPEN

SUB-THROTTLE FULL-CLOSE

SUB-THROTTLE HALF-OPEN

SUB-THROTTLE FULL-OPEN

FIG. 19A
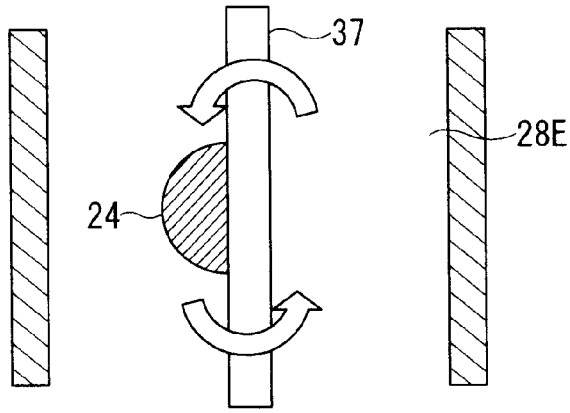
FIG. 19B
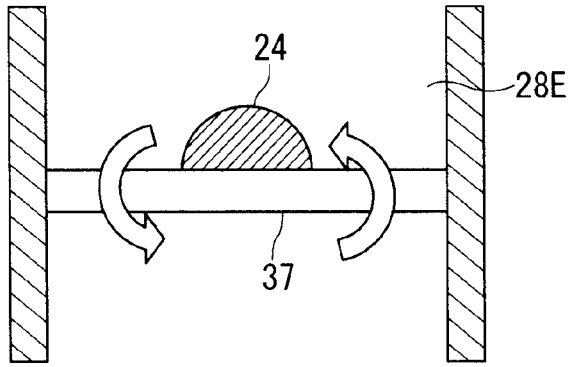
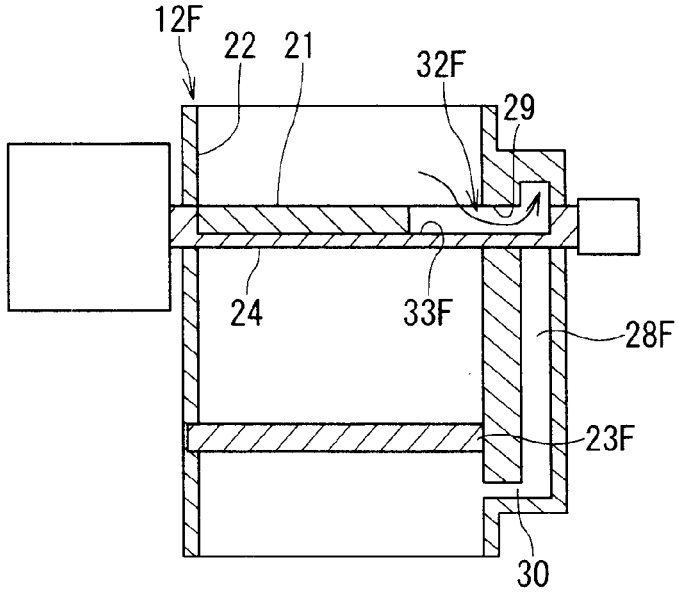
FIG. 20

INTAKE CONTROL DEVICE FOR VEHICLE ENGINE

CROSS-REFERENCE TO RELATED APPLICATIONS

This application is a non-provisional Patent Application claiming priority to Japanese Patent Application No. JP2007/197041, filed on Jul. 30, 2007, the contents of which are Incorporated herein by reference.

BACKGROUND OF THE INVENTION

1. Field of the Invention

The present invention relates to an intake control device particularly for a vehicle engine.

2. Related Art

The rpm (revolution per minute: output power) of an engine used in a motorcycle or automobile is controlled by opening/closing a throttle valve provided in an intake air path introducing an intake air into a cylinder so as to increase or decrease an amount of the intake air flowing into the cylinder.

An idle speed control (ISC) has been known as a countermeasure against changeover time or variations that would occur due to a throttle bore clogged with carbon, for example. To execute the ISC, a bypass air path should be provided to communicate with upstream and downstream sides of the throttle valve in an intake air path to control an air flow rate in the bypass air path.

As an example of an intake control device for carrying out the ISC, there is a device provided with a main throttle valve and a sub-throttle valve in an intake air path, and in addition, a bypass communicating with upstream and downstream sides of the main throttle valve. The bypass is also provided with an ISC valve, and the ISC valve and the sub-throttle valve are independently controlled with an ECU, for example (see Japanese Unexamined Patent Application Publication Nos. 06-108904 and 06-146940).

Further, there is another device including a main path constituting an intake air path and an, auxiliary path constituting a bypass parallel to the main path, in which the main path is provided with a main valve and the auxiliary path is provided with an auxiliary valve. Both the valves are coaxially and rotatably integrated, and an air control valve is separately provided in the auxiliary path, for example (see Japanese Unexamined Patent Application Publication No. 05-180038).

Further, there is still another intake control device including a main throttle valve and a sub-throttle valve in an intake air path and operating the sub-throttle valve to perform FID control, for example (see Japanese Unexamined Patent Application Publication No. 2002-129987).

However, as for the devices described in Japanese Unexamined Patent Application Publication Nos. 06-108904 and 06-146940, driving actuators should be arranged for each valve in order to independently control the ISC valve and the sub-throttle valve with the ECU. As a result, the device structure is made complicated or a device cost increases.

Further, in the case of separately providing the air control valve in the auxiliary path as described in Japanese Unexamined Patent Application Publication No. 05-180038, the ISC is executed by driving the air control valve. In this case, even if the air control valve is fully opened, the auxiliary valve and the main valve are both fully closed, so that this technique is unsuitable for the ISC.

Moreover, the intake control device described in Japanese Unexamined Patent Application Publication No. 2002-129987 requires a complicated link mechanism for transmitting a rotative force of the sub-throttle valve to the main throttle valve, leading to the complicated device structure and an increase in device cost.

In addition, the above device has the following drawback. It is difficult to apply the device to the ISC that requires high-precision and high-accuracy control compared with the FID control in consideration of machining errors or dimensional tolerances of transmission units and joints in a complicated link mechanism.

SUMMARY OF THE INVENTION

The present invention has been accomplished in view of the above circumstances, and an object of the present invention is to provide an intake control device for a vehicle engine that can surely execute an idle speed control (ISC) with a simple structure.

In one aspect of the present invention, the above and other objects can be achieved by providing an intake control device for a vehicle engine, comprising:

a throttle body;

a main throttle valve configured to be opened or closed in response to an operation applied to a throttle grip, the main throttle valve being rotatably supported by the throttle body;

a sub-throttle valve configured to be opened or closed under control of an actuator, the sub-throttle valve being rotatably supported by the throttle body;

an intake air path formed in the throttle body and provided with the main throttle valve and the sub-throttle valve so as to open or close the intake air path; and a bypass air path that is different from the intake air path and provided with an idle speed control (ISC) valve that is controlled so as to open or close the bypass air path in conjunction with the sub-throttle valve.

In a preferred embodiment of the above aspect, it may be desired that the ISC valve rotates in an opening direction thereof in conjunction with an opening operation of the sub-throttle valve. The ISC valve is fully closed when the sub-throttle valve is fully closed.

It may be also desired that the ISC valve rotates in a closing direction thereof in conjunction with an opening operation of the sub-throttle valve. The ISC valve is fully closed when the sub-throttle valve is fully opened.

It may be also desired that the bypass air path communicates with an upstream side of the sub-throttle valve and a downstream side of the main throttle valve in the intake air path, and the ISC valve is rotatably and pivotally supported coaxially with a sub-valve shaft on which the sub-throttle valve is rotatably and pivotally mounted. The bypass air path may be provided in a manner offset from a main valve shaft on which the main throttle valve is pivotally supported, as viewed from an axial direction of the sub-valve shaft.

It may be desired that a main valve shaft, on which the main throttle valve is pivotally supported, crosses the bypass air path, and a through-hole is formed in the main valve shaft to communicate with upstream and downstream sides of the bypass air path with a position of the through-hole being determined such that the bypass air path communicates therewith only at substantially opening at which the main throttle valve is fully closed.

It may be further desired that at least a predetermined portion of the sub-valve shaft in the bypass air path is deformed to constitute the ISC valve, and a sub-valve shaft is formed so as to close the bypass air path when the sub-throttle valve is opened at predetermined opening. The bypass air path may be provided in a manner offset from a main valve shaft on which the main throttle valve is pivotally supported, as viewed from an axial direction of the sub-valve shaft.

It may be further desired that a main valve shaft, on which the main throttle valve is pivotally supported, crosses the bypass air path, and a through-hole is formed in the main valve shaft to communicate with upstream and downstream sides of the bypass air path with a position of the through-hole being determined such that the bypass air path communicates therewith only at substantially opening at which the main throttle valve is fully closed.

The throttle body may include a plurality of intake air paths and a common bypass air path that communicates with each of the plurality of intake air paths.

In another aspect of the present invention, there is also provided an intake control device for a vehicle engine, comprising:

a throttle body;

a main throttle valve configured to be opened or closed in response to an operation applied to a throttle grip, the main throttle valve being rotatably supported by the throttle body;

a sub-throttle valve configured to be opened or closed under control of an actuator, the sub-throttle valve being rotatably supported by the throttle body;

an intake air path formed in the throttle body and provided with the main throttle valve and the sub-throttle valve so as to open or close the intake air path; and a bypass air path that is different from the intake air path and provided with an idle speed control (ISC) valve that is controlled so as to open or close the bypass air path in conjunction with the sub-throttle valve by opening or closing the sub-throttle valve under control of the actuator when the main throttle valve is fully closed.

In this aspect, it may be desired that the throttle body includes a plurality of intake air paths and a common bypass air path that communicates with each of the plurality of intake air paths.

The intake control device according to the present invention can eliminate any special ISC valve driving mechanism that is necessary for conventional technology, simplify the structure, reduce device size and weight and save manufacturing costs.

In addition, the ISC can be surely executed with a simple structure. In particular, the device does not require a complicated link structure as in a conventional device and has no possibility of being out of control due to the loss of synchronization or the like. Thus, it is possible to suppress variations in accuracy among mass-produced devices due to machining errors or dimensional tolerances and execute ISC with high accuracy.

The nature and further characteristic features of the present invention will be made clearer from the descriptions made with reference to the accompanying drawings.

BRIEF DESCRIPTION OF THE DRAWINGS

In the accompanying drawings:

FIGS. 19A and 19B are sectional views of a modified embodiment;

FIG. 20 is a schematic longitudinally sectional view of a throttle body according to a third embodiment of the present invention;

DESCRIPTION OF THE PREFERRED EMBODIMENTS

Hereinafter, embodiments of the present invention will be described with reference to the accompanying drawings. Further, it is to be noted that terms "upper", "lower", "right", "left" and the like terms are used herein with reference to the illustrations of the drawings or in a usable stage of a device.

Figure 1:
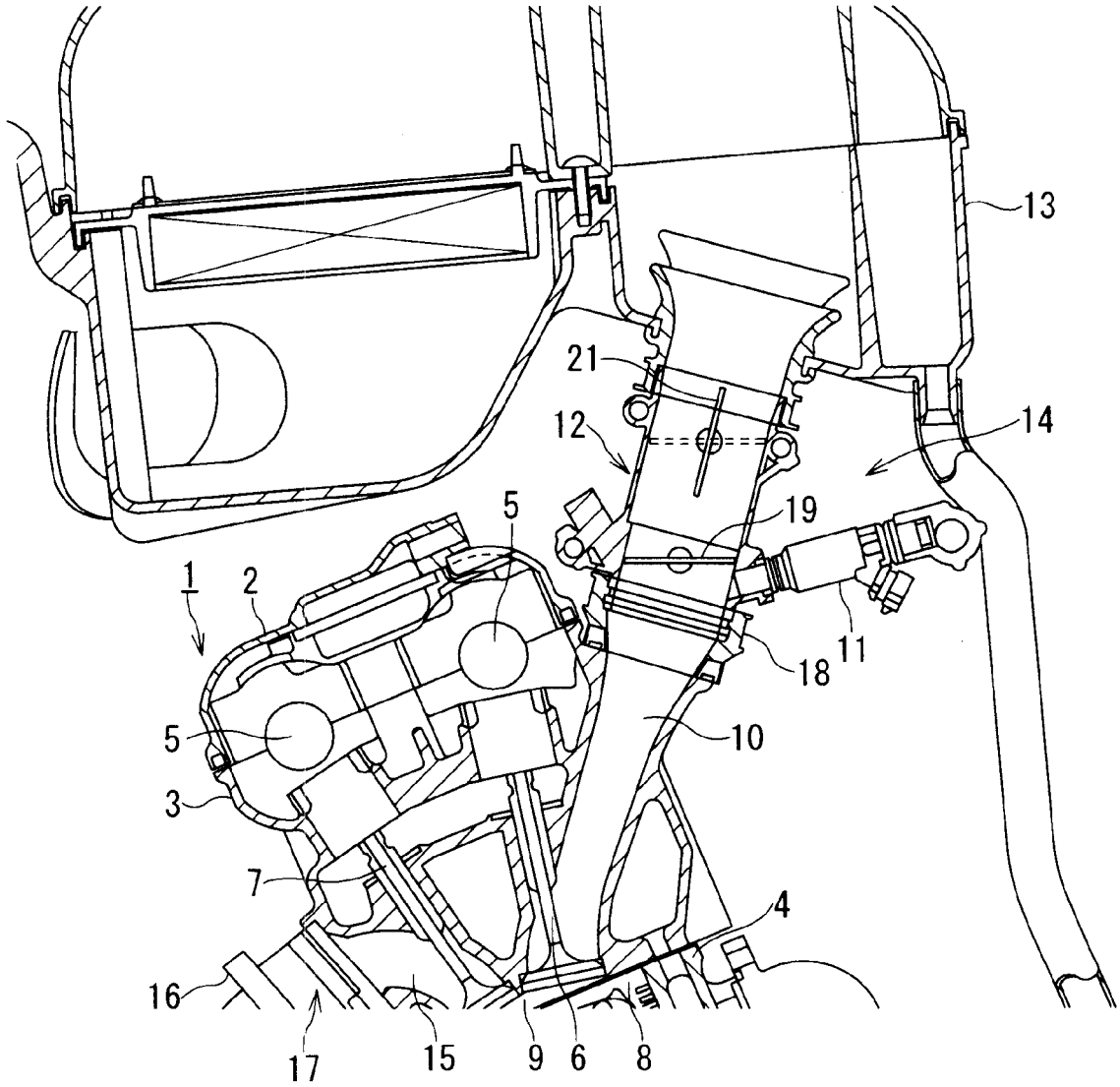
FIG. 1 is a partial longitudinal sectional view of a motorcycle engine and intake system as an intake control device according to first embodiment of the present invention.
Figure 2:
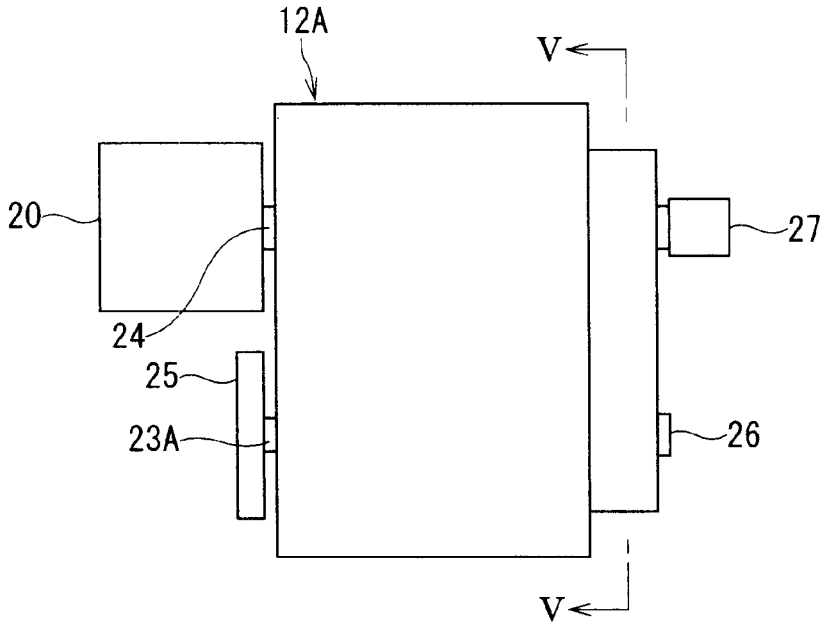
FIG. 2 is a schematic front view of a throttle body according to a first embodiment of the present invention.
Figure 3:
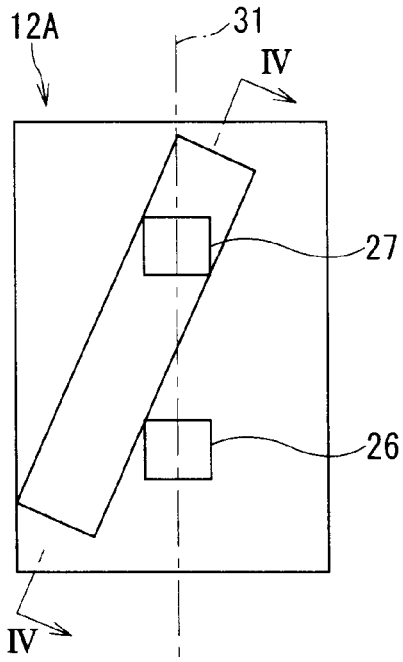
FIG. 3 is a left-sided view of the throttle body of FIG. 2.
Figure 4:
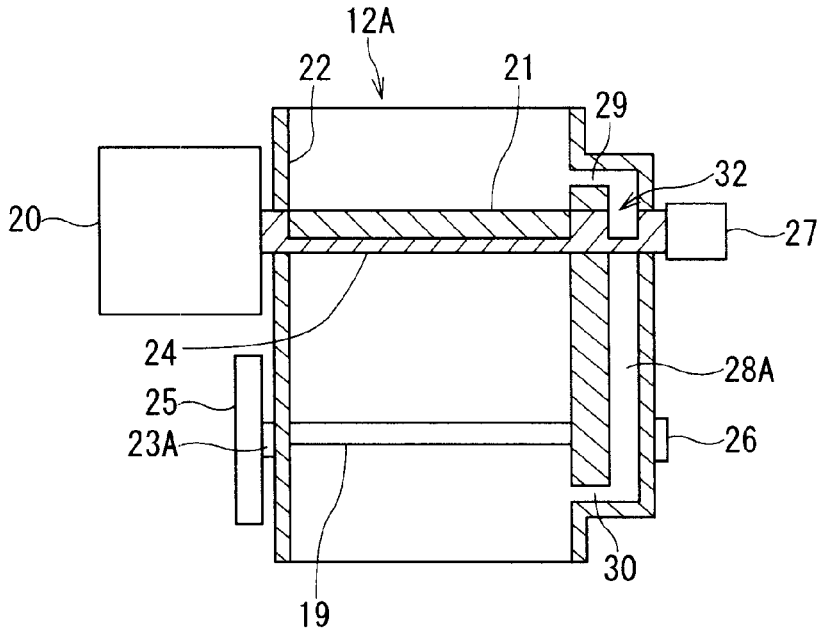
FIG. 4 is a sectional view taken along the line IV-IV of FIG. 3.
Figure 5:
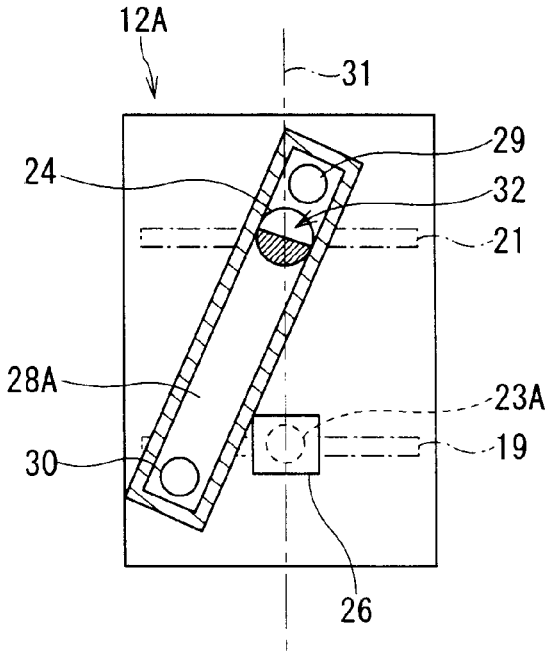
FIG. 5 is a sectional view taken along the line V-V of FIG. 2.
Figure 6A:
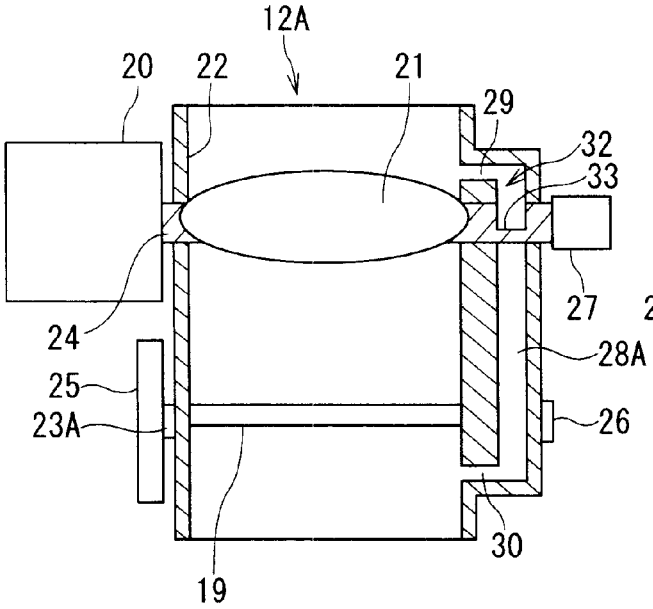
FIGS. 6A and 6B are sectional views of a sub-throttle valve in a half-opened state.
Figure 6B:
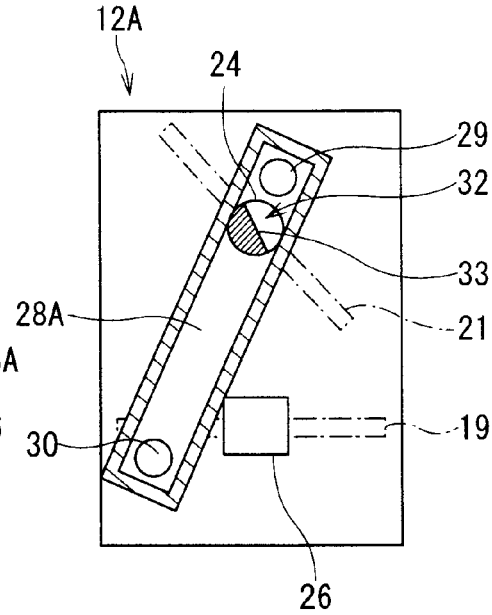
Figure 7A:
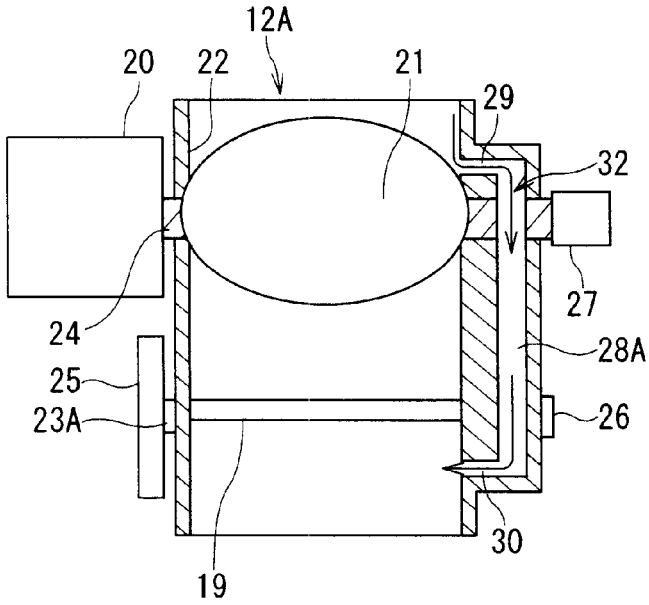
FIGS. 7A and 7B are sectional views of a sub-throttle valve 21 in a full-opened state.
Figure 7B:
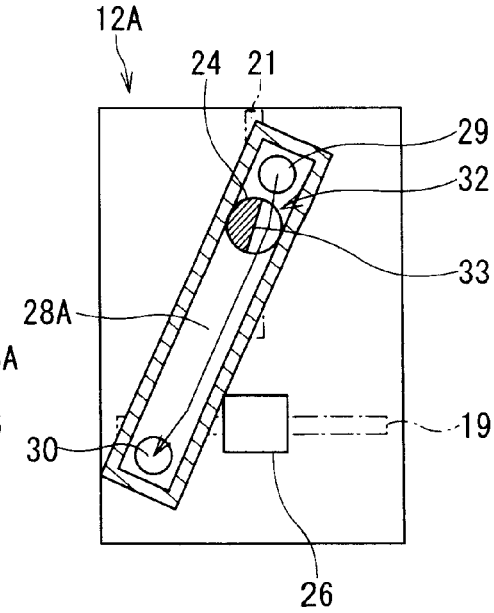

With reference to FIG. 1 showing a partial longitudinal sectional view of a motorcycle engine and intake system according to the first embodiment of the present invention, an engine 1 mainly includes a cylinder head cover 2, a cylinder head 3, a cylinder block 4, and a crank case, not shown, to thereby form an outer configuration thereof.

A pair of front and rear cam shafts 5, 5 constituting a valve gear (valve moving unit) is provided in the cylinder head 3. The cam shafts 5, 5 serve to open or close intake/exhaust valves 6, 7 in the cylinder head 3. An upper opening of the cylinder head 3 is closed with the cylinder head cover 2.

On the other hand, a piston 8 is slidably inserted into the cylinder block 4. A combustion chamber 9 is formed between the cylinder head 3 and the piston 8, and an ignition plug, not shown, is externally screwed to the center thereof.

An air fuel mixture is supplied to the engine 1 by a fuel injection system. A throttle body 12 provided with a fuel injector 11 (fuel injection device) is connected to an intake port 10 arranged on a back side of the cylinder head 3. The throttle body 12 is located above and behind the engine 1, and an air cleaner 13 is connected to an upstream side of the throttle body 12.

On the other hand, an upstream end of an exhaust pipe 16 is connected to an exhaust port 15 arranged in front of the cylinder head 3, and a silencer, not shown, is connected to a downstream end thereof. In this way, an exhaust system 17 is completed.

The throttle body 12 is connected to the upstream side of the intake port 10 through an intake pipe 18 as described above. A main throttle valve 19 is provided in the throttle body 12. The valve is opened or closed by a throttle cable connected to a throttle grip, not shown. Provided on the upstream side of the main throttle valve 19 is a sub-throttle valve 21 which is closed or opened under the control of an electric motor 20 that is an actuator as described above. The fuel injector 11 is provided to the throttle body 12 so as to inject a fuel toward the downstream side of the main throttle valve 19.

As shown in FIGS. 2 to 5 representing the first embodiment of the present invention, the throttle body 12A includes an intake air path 22 extending vertically in figures. In FIGS. 2 to 5, an intake air flows from an upper side (air cleaner 13 side) of the throttle body 12A toward a lower side thereof (engine 1 side).

The intake air path 22 is provided with the main throttle valve 19 and a sub-throttle valve 21. The main throttle valve 19 is axially supported to the downstream side of the intake air path 22 through a main valve shaft 23A so as to be opened or closed, and the sub-throttle valve 21 is axially supported to the upstream side of the intake air path 22 through a sub-valve shaft 24 also so as to be opened or closed.

The main valve shaft 23A protrudes from the throttle body 12A at one end, and a throttle pulley 25 connected to the throttle cable is provided at the protruding end. Further, the main valve shaft 23A protrudes from the throttle body 12 at the other end as well, and a main throttle position sensor 26 is connected to the protruding end.

On the one hand, the sub-valve shaft 24 protrudes from the throttle body 12A at one end, and the electric motor 20 for opening or closing the sub-throttle valve 21 is provided at the protruding end. The sub-valve shaft 24 protrudes from the throttle body 12A at the other end, and a sub-throttle position sensor 27 is connected to the protruding end.

Further, a bypass air path 28A is provided near the intake air path 22 in addition to the intake air path 22. The bypass air path 28A communicates with a bypass air inlet 29 formed in the wall of the throttle body 12A on the upstream side of the sub-throttle valve 21 and with a bypass air outlet 30 formed in the wall of the throttle body 12A on the downstream side of the main throttle valve 19 in the intake air path 22, for example. In the first embodiment, the bypass air path 28A is integrated with a side portion of the throttle body 12A or provided integrally therewith.

The bypass air inlet 29 is formed closer to and almost above the sub-valve shaft 24 as seen in a side view, while the bypass air outlet 30 is formed below the main valve shaft 23A at some distance therefrom as seen in a side view, and the bypass air path 28A is provided obliquely to cross an axial line 31 of the intake air path 22 so as not to overlap the main valve shaft 23A as seen in a side view. The other end of the sub-valve shaft 24 extending toward the sub-throttle position sensor 27 side crosses the bypass air path 28A and protrudes to the outside.

A flow rate of an air flowing through the bypass air path 28A is regulated with an ISC valve 32 provided in the bypass air path 28A. At least a portion of the sub-valve shaft 24 in the bypass air path 28A is deformed to form the ISC valve 32. Further, the sub-valve shaft 24 is formed so as to close the bypass air path 28A.

As shown in FIG. 4 to FIGS. 7A and 7B, the ISC valve 32 is arranged coaxially with the sub-valve shaft 24 and controlled so as to open or close in conjunction with the sub-throttle valve 21. More specifically, in this embodiment, the ISC valve 32 has a concave groove shape formed by cutting the sub-valve shaft 24 as seen in a side view. A bottom 33 of the ISC valve 32 is positioned on the center line of the sub-valve shaft 24. The ISC valve 32 is set to open along with an opening operation of the sub-throttle valve 21 and to fully close if the sub-throttle valve 21 is totally closed.

Figure 8A:
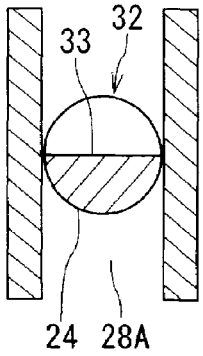
FIGS. 8A to 8C are sectional views of a sub-valve shaft having an ISC valve formed therein (first example of the first embodiment)
Figure 8B:
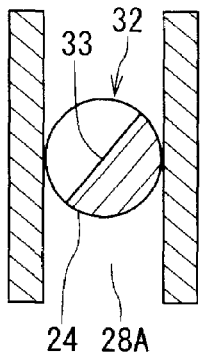
Figure 8C:
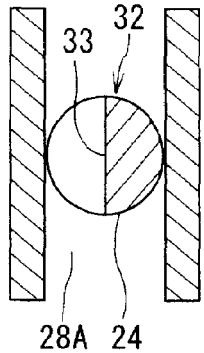

FIGS. 8A to 8C are sectional views of the sub-valve shaft 24 having the ISC valve 32 formed therein according to a first example of the first embodiment. In FIG. 8A, the sub-throttle valve 21 is fully closed. In FIG. 8B, the sub-throttle valve 21 is half-opened. In FIG. 8C, the sub-throttle valve 21 is fully opened.

As shown in FIG. 8A, the ISC valve 32 on the sub-valve shaft 24 in the bypass air path 28A has a semi-circular sectional shape, for example. When the sub-throttle valve 21 is fully closed, the bottom 33 of the ISC valve 32 is positioned orthogonally to the axis of the bypass air path 28A, so that the bypass air path 28A is fully closed. As shown in FIG. 8B, along with an opening operation of the sub-throttle valve 21, the bypass air path 28A starts to open. As shown in FIG. 8C, if the sub-throttle valve 21 is fully opened, the bottom 33 of the ISC valve 32 is positioned in parallel to the axis of the bypass air path 28A, so that the bypass air path 28A fully opens.

The ISC valve 32 discussed in the above operational mode has a structure such that the bypass air path 28A and the sub-throttle valve 21 start to open at substantially the same time. However, the bypass air path 28A may open with a delay as follows, for example.

Figure 9A:
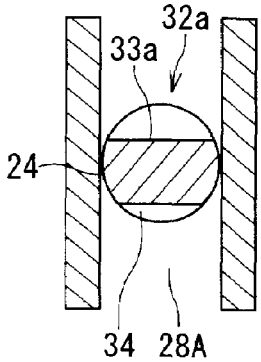
FIGS. 9A to 9C are sectional views of a sub-valve shaft having an ISC valve formed therein (second example of the first embodiment)
Figure 9B:
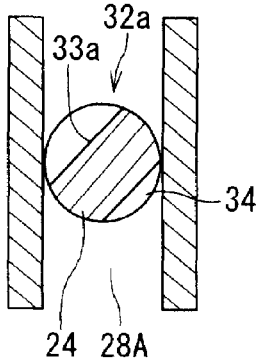
Figure 9C:
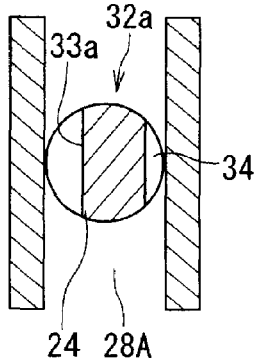

FIGS. 9A to 9C are sectional views of the sub-valve shaft 24 having an ISC valve 32*a* formed therein according to a second example of the first embodiment. In FIG. 9A, the sub-throttle valve 21 is fully closed. In FIG. 9B, the sub-throttle valve 21 is half-opened. In FIG. 9C, the sub-throttle valve 21 is fully opened.

As shown in FIG. 9A, the ISC valve 32*a* on the sub-valve shaft 24 in the bypass air path 28A has a semi-circular sectional shape, for example, with the bottom 33*a* being positioned above the center line of the sub-valve shaft 24. When the sub-throttle valve 21 is fully closed, the bottom 33*a* of the ISC valve 32 is positioned orthogonally to the axis of the bypass air path 28A, in which the bypass air path 28A is fully closed. As shown in FIG. 9B, even after the sub-throttle valve 21 starts to open, the bypass air path 28A is kept closed until the bottom 33*a* of the ISC valve 32*a* reaches the wall of the path, for example. As shown in FIG. 8C, if the sub-throttle valve 21 is fully opened, the bypass air path 28A fully opens.

If the bottom 33*a* of the sub-throttle valve 21*a* is positioned above the center line of the sub-valve shaft 24, a flow path area becomes smaller than that of the first embodiment at the time of fully opening the ISC valve 32. However, if a cutout 34 corresponding to the shortage is formed on the opposite side across the center line of the sub-valve shaft 24, a flow path area equal to that of the first embodiment can be secured at the time of fully opening the ISC valve 32.

Figure 10A:
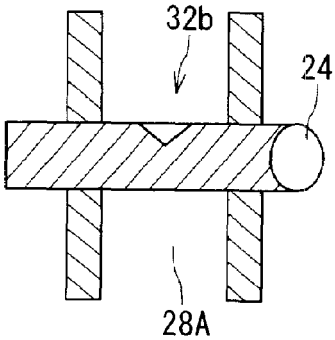
FIGS. 10A to 10C are sectional views of a sub-valve shaft having an ISC valve formed therein (third example of the first embodiment)
Figure 10B:
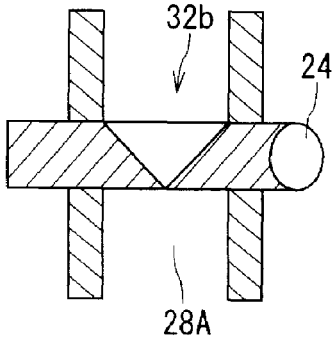
Figure 10C:
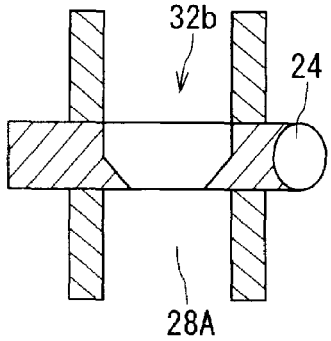

FIGS. 10A to 10C are sectional views of the sub-valve shaft 24 having an ISC valve 32*b* formed therein according to a third example of the first embodiment.

In FIG. 10A, the sub-throttle valve 21 is fully closed. In FIG. 10B, the sub-throttle valve 21 is half-opened. In FIG. 10C, the sub-throttle valve 21 is fully opened. As shown in FIGS. 10A to 10C, in the third embodiment, the ISC valve 32*b* is a wedge-shaped groove-like cutout as seen in a side view.

Figure 11:
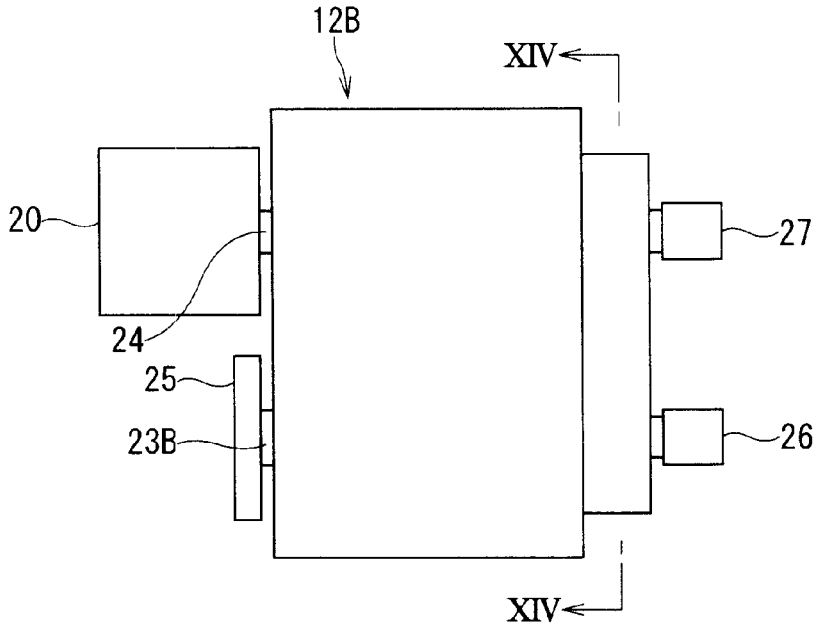
FIG. 11 is a schematic front view of a throttle body according to a second embodiment of the present invention.
Figure 12:
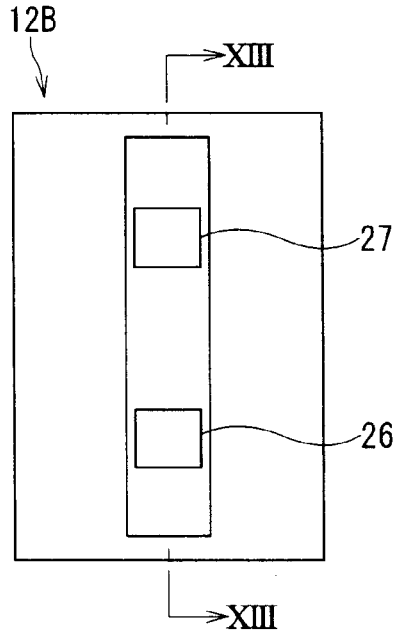
FIG. 12 is a left-sided view of the throttle body of FIG. 11.
Figure 13:
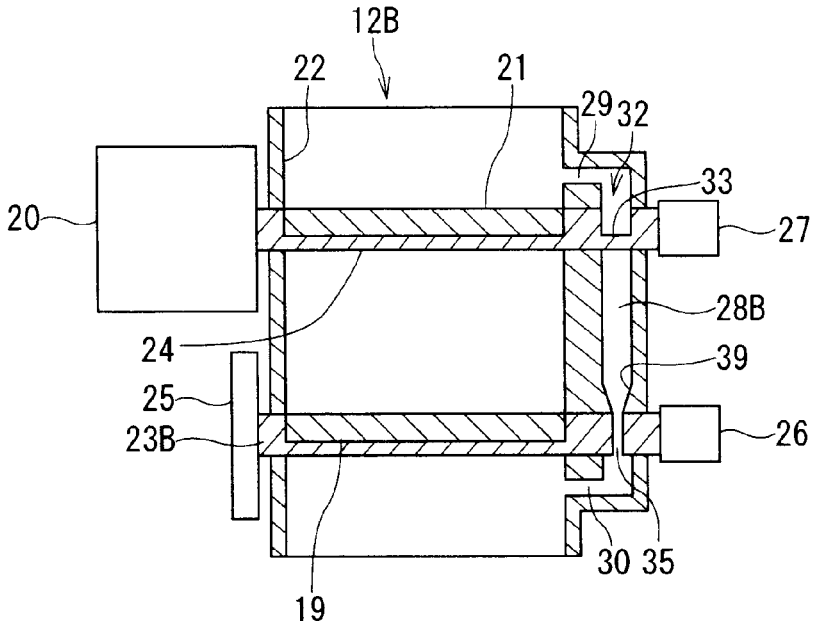
FIG. 13 is a sectional view taken along the line XIII-XIII of FIG. 12.
Figure 14:
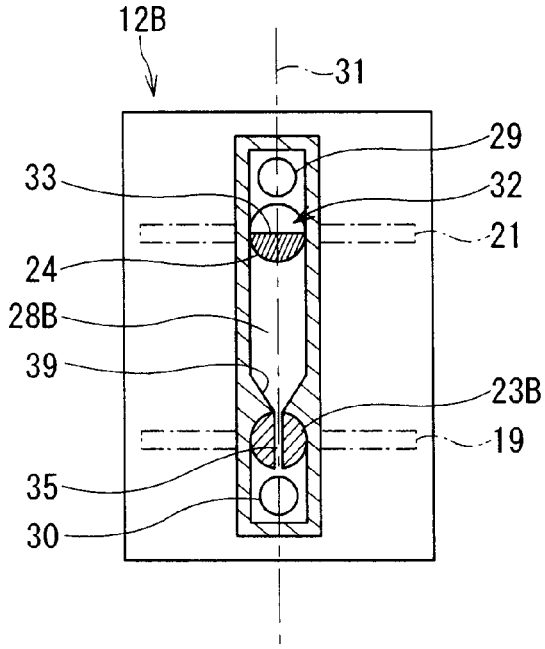
FIG. 14 is a sectional view taken along the line XIV-XIV of FIG. 11.

FIG. 11 is a schematic front view of a throttle body 12B according to the second embodiment of the present invention. FIG. 12 is a left-sided view thereof. FIG. 13 is a sectional view taken along the line XIII-XIII of FIG. 12. FIG. 14 is a sectional view taken along the line XIV-XIV of FIG. 11. The same components as those of the throttle body 12A of the first embodiment are denoted by identical reference numerals and description thereof is omitted.

As shown in FIGS. 11 to 14, the throttle body 12B includes the intake air path 22 extending vertically in figures. The intake air path 22 is provided with the main throttle valve 19 and the sub-throttle valve 21. The main throttle valve 19 is axially supported to the downstream side of the intake air path 22 through a main valve shaft 23B so as to be opened or closed, and the sub-throttle valve 21 is axially supported to the upstream side of the intake air path 22 through the sub-valve shaft 24 so as to be opened or closed.

The main valve shaft 23B protrudes from the throttle body 12B at one end, and the throttle pulley 25 connected to the throttle cable is provided at the protruding end. Further, the main valve shaft 23B protrudes from the throttle body 12B at the other end, and the main throttle position sensor 26 is connected to the protruding end.

On the other hand, the sub-valve shaft 24 protrudes from the throttle body 12B at one end, and the electric motor 20 for opening or closing the sub-throttle valve 21 is provided at the protruding end. The sub-valve shaft 24 protrudes from the throttle body 12B at the other end, and the sub-throttle position sensor 27 is connected to the protruding end.

Meanwhile, a bypass air path 28B is provided to the intake air path 22. The bypass air path 28B communicates with the bypass air inlet 29 formed in the wall of the throttle body 12B on the upstream side of the sub-throttle valve 21 and with the bypass air outlet 30 formed in the wall of the throttle body 12B on the downstream side of the main throttle valve 19 in the intake air path 22, for example. In the second embodiment, the bypass air path 28B is integrated with a side portion of the throttle body 12B or provided integrally therewith.

The bypass air inlet 29 is formed closer to and almost above the sub-valve shaft 24 as seen in a side view, while the bypass air outlet 30 is formed below the main valve shaft 23B at some distance therefrom as seen in a side view, and the bypass air path 28B is provided obliquely to cross the axial line 31 of the intake air path 22 as seen in a side view. The other end of the sub-valve shaft 24 extending toward the sub-throttle position sensor 27 side crosses the bypass air path 28B and protrudes to the outside. In addition, the other end of the main valve shaft 23 extending toward the main throttle position sensor 26 side crosses the bypass air path 28B and protrudes to the outside.

A flow rate of an air flowing through the bypass air path 28B is regulated with the ISC valve 32 provided in the bypass air path 28B. At least a portion of the sub-valve shaft 24 in the bypass air path 28B is deformed to form the ISC valve 32. Further, the sub-valve shaft 24 is formed so as to close the bypass air path 28B.

The ISC valve 32 is arranged coaxially with the sub-valve shaft 24 and controlled to open or close in conjunction with the sub-throttle valve 21. More specifically, in this embodiment, the ISC valve 32 is a concave groove formed by cutting the sub-valve shaft 24 as seen in a side view. The bottom 33 of the ISC valve 32 is positioned on the center line of the sub-valve shaft 24. The ISC valve 32 is set to open along with an opening operation of the sub-throttle valve 21 and to fully close if the sub-throttle valve 21 is totally closed.

On the other hand, a through-hole 35 is formed in the main valve shaft 23 crossing the bypass air path 28B. The through-hole 35 communicates with upstream and downstream sides of the main valve shaft 23B in the bypass air path 28B. The through-hole 35 is formed so as to communicate with the upstream and downstream sides of the main valve shaft 23B in the bypass air path 28B only when the main throttle valve 19 is fully closed.

Figure 15A:
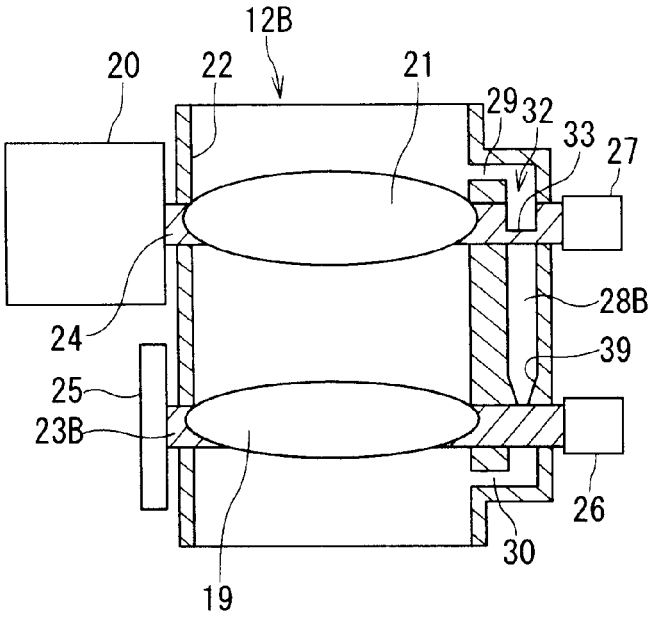
FIGS. 15A and 15B are sectional views of a sub-valve shaft in the case where a sub-throttle valve is half-opened, and a main throttle valve is slightly opened.
Figure 15B:
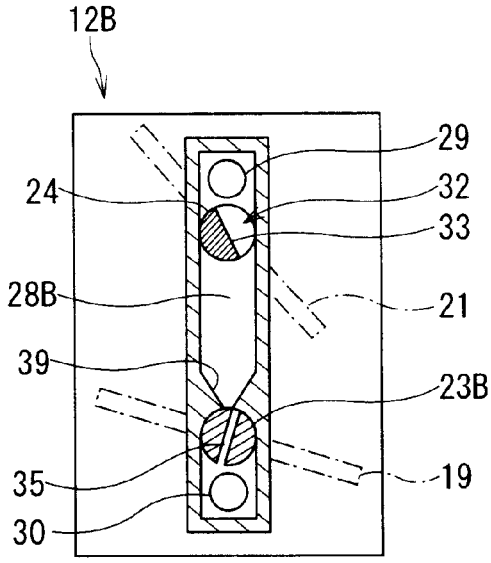
Figure 16A:
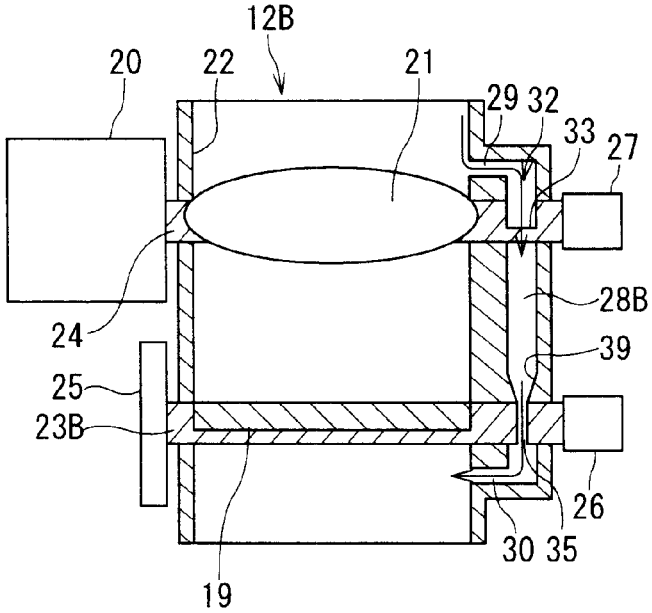
FIGS. 16A and 16B are sectional views of a sub-valve shaft in the case where a sub-throttle valve is half-opened, and a main throttle valve is fully closed.
Figure 16B:
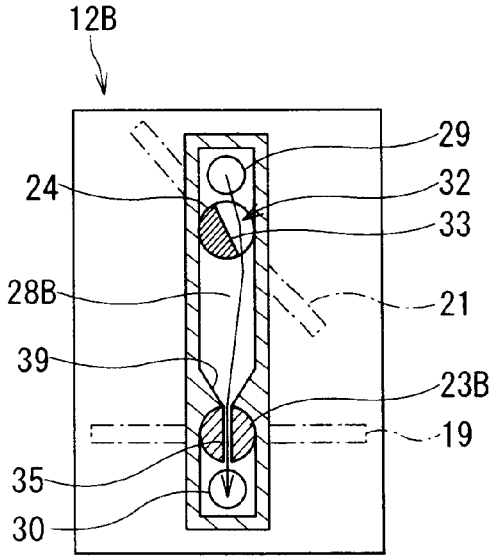
Figure 17A:
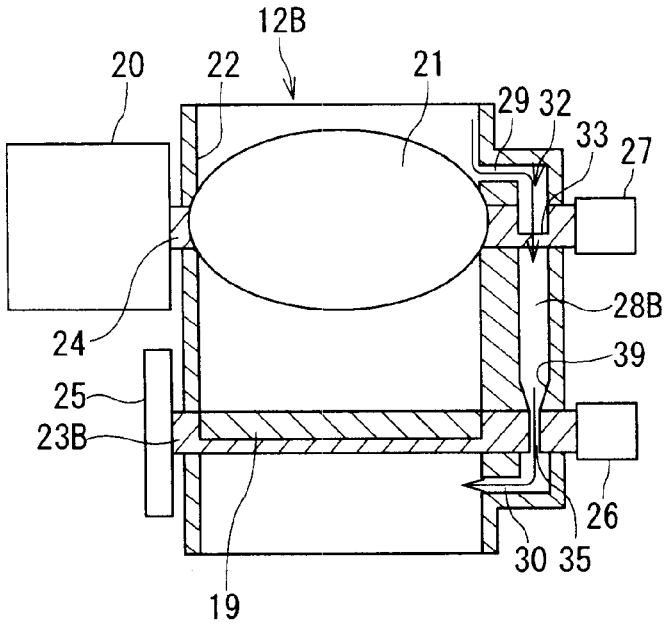
FIGS. 17A and 17B are sectional views of a sub-valve shaft in the case where a sub-throttle valve is fully opened, and a main throttle valve is fully closed.
Figure 17B:
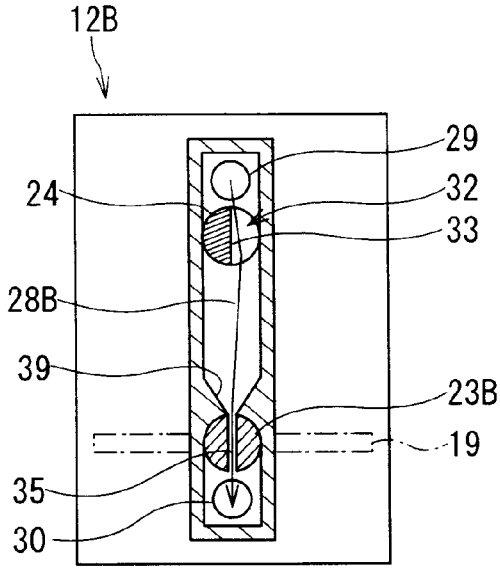

FIGS. 15A and 15B are sectional views of the sub-valve shaft 24 in the case where the sub-throttle valve 21 is half-opened, and the main throttle valve 19 is slightly opened. FIGS. 16A and 16B are sectional views of the sub-valve shaft 24 in the case where the sub-throttle valve 21 is half-opened, and the main throttle valve 19 is fully closed. FIGS. 17A and 17B are sectional views of the sub-valve shaft 24 in the case where the sub-throttle valve 21 is fully opened, and the main throttle valve 19 is fully closed.

As shown in FIGS. 15A and 15B, even if the ISC valve 32 opens along with the opening operation of the sub-throttle valve 21, when the main throttle valve 19 is opened even a little, the upstream side and downstream side of the main valve shaft 23 do not communicate with each other. As a result, no bypass air flows through the bypass air path 28B.

On the other hand, if the main throttle valve 19 is fully closed, the upstream side and downstream side of the main valve shaft 23 in the bypass air path 28B communicate with each other. Thus, if the ISC valve 32 opens along with the opening operation of the sub-throttle valve 21, a bypass air can flow therethrough.

Figure 18A:
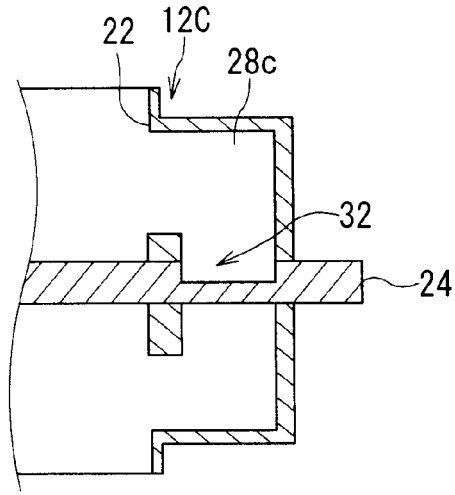
FIGS. 18A to 18C are sectional views of a modified embodiment.

A flow rate of the bypass air flowing through the bypass air paths 28A and 28B is regulated in accordance with the opening of the sub-throttle valve 21. A basic flow rate, which is measured at the full opening of the sub-throttle valve 21, can be controlled in accordance with a sectional area of the bypass air paths 28A and 28B. For example, as shown in FIG. 18A, if the wall of a bypass air path 28C is elongated in the axial direction of the sub-valve shaft 24 (cutout of the ISC valve 32 is similarly elongated), the basic flow rate of a bypass air at the full opening of the sub-throttle valve 21 may be increased.

Figure 18B:
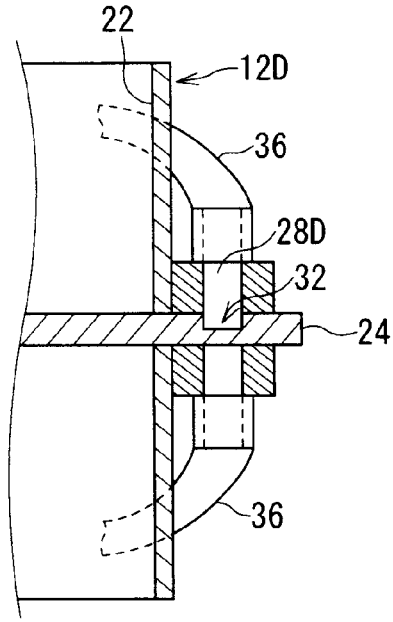
Figure 18C:
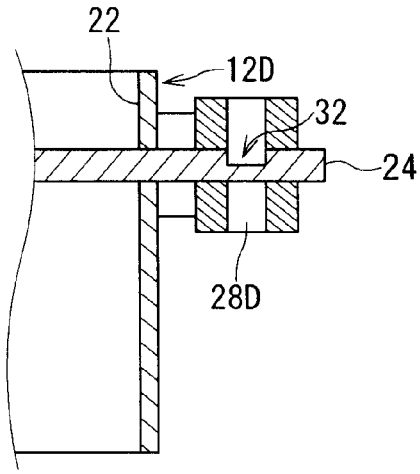

In the above embodiment, the intake air path 22 of the throttle bodies 12A and 12B is formed such that the bypass air inlet 29 and the bypass air outlet 30 communicate with each other by way of the bypass air paths 28A and 28B integrated with side portions of the throttle bodies 12A and 12B or integrally provided thereto. As shown in FIG. 18B, however, if upstream and downstream sides of the ISC valve 32 are connected with the intake air path 22 of a throttle body 12D using a host 36 as a pipe, for example, the pipe and the ISC valve 32 can be laid out with high degree of freedom. Further, in the case of using the hose 36 as a pipe, as shown in FIG. 18C, the ISC valve 32 can be placed away from the throttle body 12D.

As a method of increasing the basic flow rate of a bypass air flowing through the bypass air path 28C, in addition to the above method of elongating the wall of the bypass air path 28C in an axial direction of the sub-valve shaft 24, there may be provided a method in which the wall of a bypass air path 28E is elongated in a radius direction of the sub-valve shaft 24 as shown in FIGS. 19A and 19B. In this case, it is difficult to regulate flow rate characteristics based on the shape of the sub-valve shaft 24 alone. Thus, the flow rate characteristics can be regulated by providing the sub-valve shaft 24 with a bypass air valve 37.

FIG. 20 is a schematic longitudinally sectional view of a throttle body 12F according to a third embodiment of the present invention. The same components as those of the throttle body 12B of the first embodiment are denoted by identical reference numerals and description thereof is omitted herein.

As shown in FIG. 20, the throttle body 12F includes the intake air path 22 extending vertically in figure. The intake air path 22 is provided with a main throttle valve, not shown, and the sub-throttle valve 21. The main throttle valve is axially supported to the downstream side of the intake air path 22 through a main valve shaft 23F so as to be opened or closed, and the sub-throttle valve 21 is axially supported to the upstream side of the intake air path 22 through the sub-valve shaft 24 so as to be opened or closed.

A bypass air path 28F is formed in the intake air path 22. The bypass air path 28F connects between the bypass air inlet 29 as a shaft hole of the sub-valve shaft 24 formed in the wall of the throttle body 12F and the bypass air outlet 30 formed in the wall of the throttle body 12F on the downstream side of the main throttle valve 19. In the third embodiment, the intake air path 22 is integrated with a side portion of the throttle body 12F or integrally provided thereto.

A flow rate of an air flowing through the bypass air path 28F is regulated with an ISC valve 32F provided in the bypass air path 28F. At least a portion of the sub-valve shaft 24 in the bypass air path 28F is deformed to form the ISC valve 32. Further, the sub-valve shaft 24 is formed so as to close the bypass air path 28F.

The ISC valve 32F is arranged coaxially with the sub-valve shaft 24 and controlled to open or close in conjunction with the sub-throttle valve 21. More specifically, in this embodiment, the ISC valve 32F is a concave groove formed by cutting the sub-valve shaft 24 as seen in a side view. The bottom 33F of the ISC valve 32F is positioned on the center line of the sub-valve shaft 24. In addition, the ISC valve 32F extends into the intake air path 22 to communicate with the intake air path 22 and the bypass air path 28F. The ISC valve 32F is set to open along with an opening operation of the sub-throttle valve 21 and to fully close if the sub-throttle valve 21 is totally closed.

Figure 21:
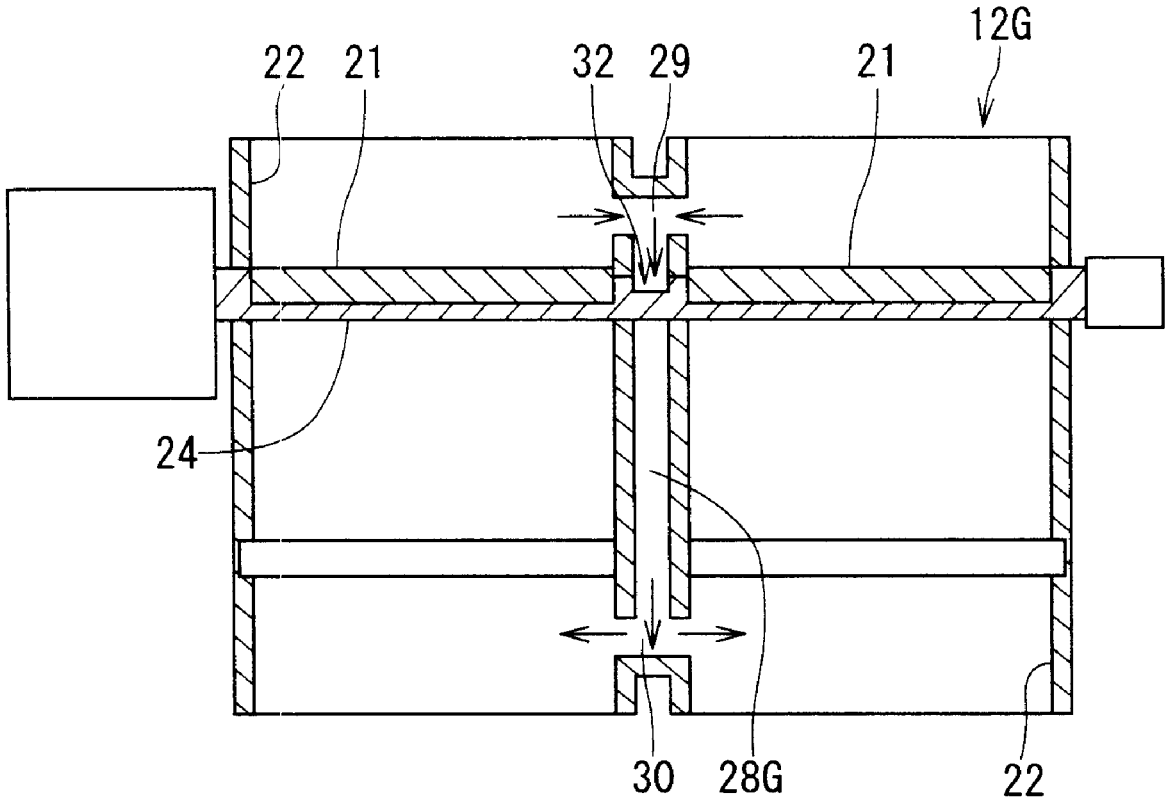
FIG. 21 is schematic longitudinally sectional view of a two-cylinder engine throttle body according to a fourth embodiment of the present invention.

In the above embodiment, one intake air path 22 is provided with one bypass air path (28A to 28F) by way of example. For example, however, as shown in FIG. 21, plural, for example, two, intake air paths 22 of a two-cylinder engine throttle body 12G in a fourth embodiment may share one bypass air path 28G. To be specific, the bypass air path 28G inserted between a pair of intake air paths 22 is adaptable to both of the intake air paths 22, so that the structure can be simplified and costs can be saved.

Figure 22:
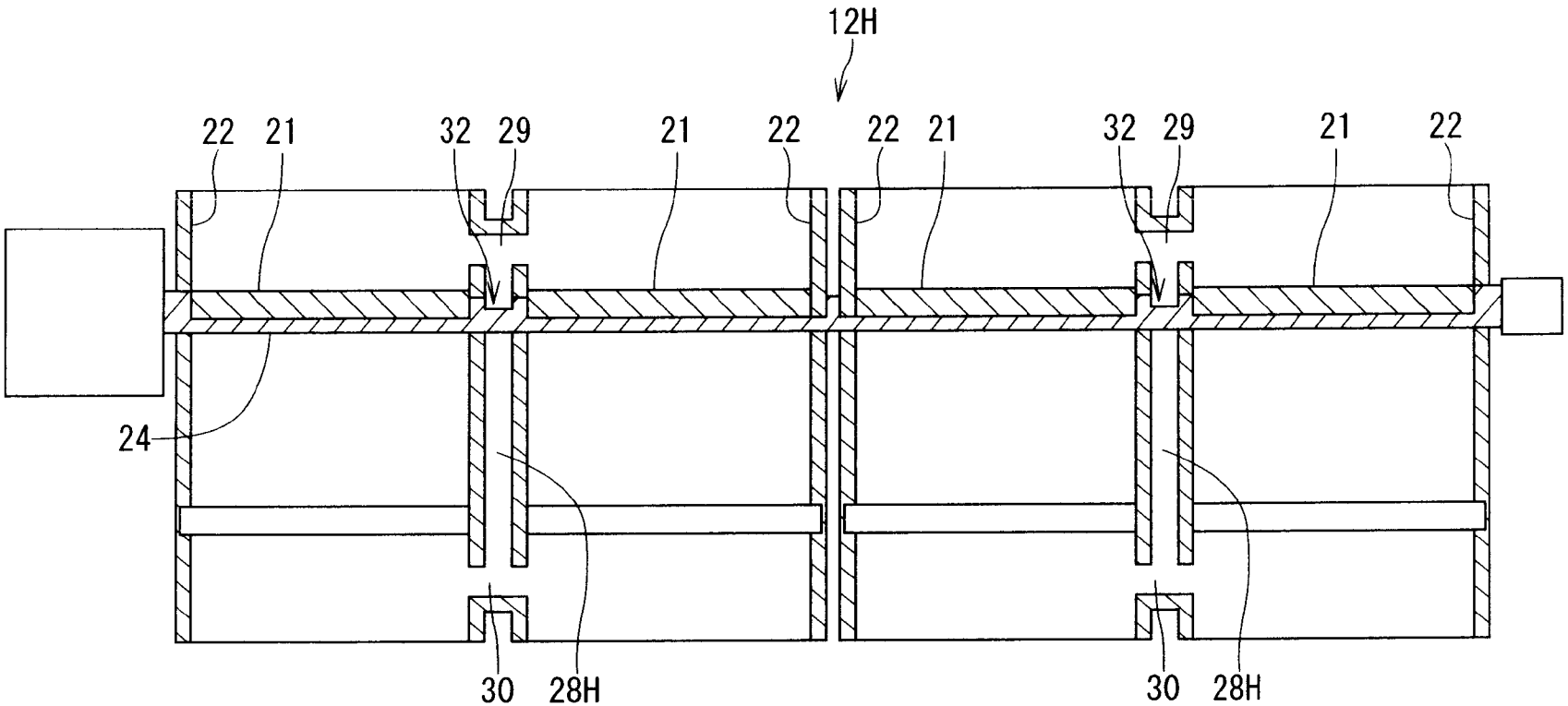
FIG. 22 is schematic longitudinally sectional view of a four-cylinder engine throttle body according to a fifth embodiment of the present invention.
Figure 23:
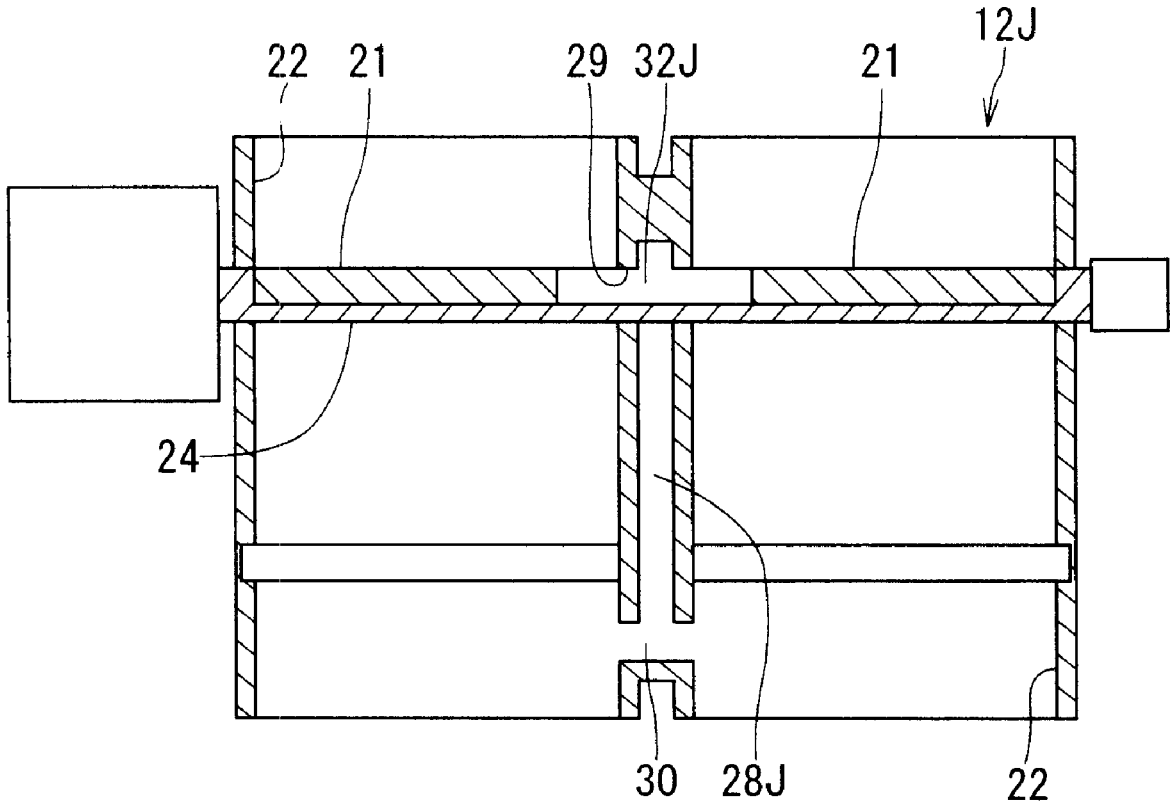
FIG. 23 is schematic longitudinally sectional view of a two-cylinder engine throttle body according to a sixth embodiment of the present invention.

Further, as described in a fifth embodiment shown in FIG. 22, if plural units each composed of two intake air paths 22 and one bypass air path 28H are connected, a throttle body 12H applicable to a four-cylinder engine is obtained. Further, as described in a sixth embodiment shown in FIG. 23, the structure including a bypass air path 28J inserted between a pair of intake air paths 22 of a throttle body 12J is applicable to the structure including an ISC valve 32J extending into the intake air path 22 as described in the third embodiment.

In the case of connecting the plural intake air paths 22 with fewer bypass air paths 28G, 28H and 28J, a requisite air flow rate can be ensured by increasing a sectional area of the bypass air paths 28C and 28E as shown in FIG. 18A and FIGS. 19A and 19B.

Figure 24:
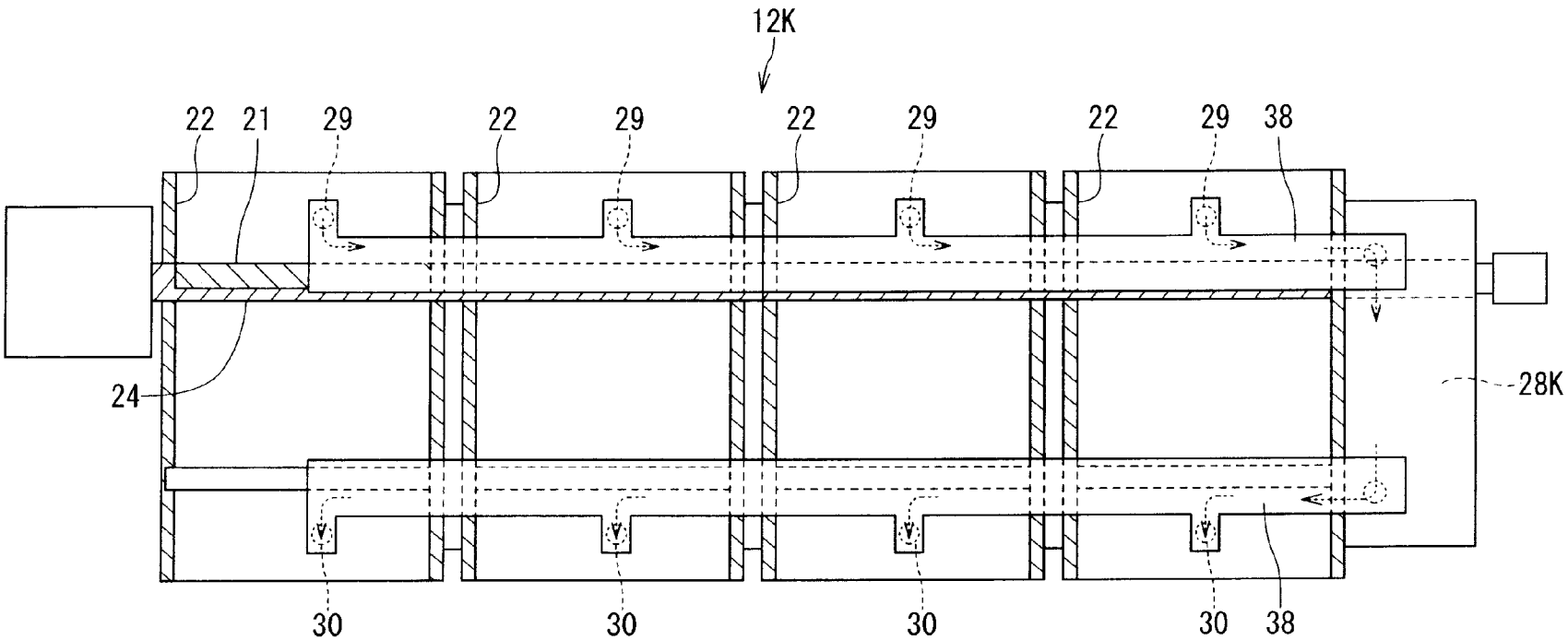
FIG. 24 is schematic longitudinally sectional view of a four-cylinder engine throttle body according to a seventh embodiment of the present invention.

As described in a seventh embodiment shown in FIG. 24, one bypass air path 28K may be provided at one side portion of a throttle body 12K, for example, to connect the bypass air inlet 29 and the bypass air outlet 30 in plural intake air paths 22, and the bypass air path 28K through a separately-provided communication pipe 38, for example, to put together bypass air paths. The communication pipe 38 may be provided integrally with the throttle body 12K. Further, a metal pipe or elastic hose may be used as the separately-provided communication pipe, for example.

The described embodiment modes will be operated as follows.

The ISC is performed by providing the bypass air paths 28A, . . . , which communicate with upstream and downstream sides of the throttle vales 19 and 20 in the intake air path 22 and controlling a flow rate of an air in the bypass air paths 28A, . . . .

The air flow rate control in the bypass air paths 28A, . . . , will be performed, such that, for example, based on the example of the first embodiment mode, the flow rate is controlled by the ISC valve 32 provided in the bypass air path 28A. The ISC valve 32 is a concave cutout formed in the sub-valve shaft 24 in the bypass air path 28A as seen in a side view. An air flow rate in the bypass air path 28A is changed in accordance with the opening of the sub-throttle valve 21 and adjusted to a desired value. The ISC valve 32 is set to open along with the opening operation of the sub-throttle valve 21 and to fully close if the sub-throttle valve 21 is fully closed.

The opening of the sub-throttle valve 21 optimum to the ISC is determined based on the information obtained by capturing signals from a crank angle sensor, not shown, of the engine 1 or the main throttle position sensor 26 provided at the end of the main valve shaft 23A in the throttle body 12A, for example, into an ECM, not shown.

Further, the FID control is performed such that target FID engine rpm is set based on the temperature of cooling water in the engine 1 or the rpm of the engine 2, or such that the sub-throttle valve 21 is adjusted to a preset opening.

Upon the idling of the engine 1, that is, upon closing the main throttle valve 19, a difference between the target engine rpm and the actual engine rpm is calculated and the sub-throttle valve 21 is adjusted to the target engine rpm based on the difference.

On the one hand, upon the unloaded racing operation or loaded (in gear) normal driving, that is, upon opening the main throttle valve 19, the opening of the sub-throttle valve 21 is controlled based on preset engine rpm-throttle position map.

On the other hand, in the case of turning the throttle grip to a full-closing position to reduce a speed, dash pot control may be performed to open the sub-throttle valve 21 to open the bypass air path 28A to control an engine brake.

As described above, the bypass air path 28A is formed in the intake air path 22, and the ISC valve 32 is provided to the bypass air path 28A and controlled so as to be opened or closed in conjunction with the sub-throttle valve 21, so that the sub-throttle valve 21 and an air flow rate in the bypass air path 28A is controlled only with the electric motor 20 for driving the sub-throttle valve 21. As at result, it is possible to omit any special ISC valve driving mechanism which is required for conventional ones, simplify the structure, reduce device size and weight, and save costs.

Furthermore, the ISC valve 32 is opened or closed in conjunction with the sub-throttle valve 21, so that the opening of the ISC valve 32 can be controlled with high accuracy by the use of the sub-throttle position sensor 27. As a result, unlike a conventional system for driving a plunger with a motor to control an air flow rate, to which a position sensor cannot be attached, the device has no possibility of being out of control due to the loss of synchronization.

Further, the sub-throttle valve 21 needs to be opened to open the ISC valve 32 upon the idling of the engine 1, but the main throttle valve 19 is totally closed at the time of opening the ISC valve 32. Therefore, an amount of an intake air flowing through the intake air path 22 is not influenced thereby.

Moreover, upon the cold starting of the engine 1, the ISC valve 32 is opened at large openings to ensure a larger amount of bypass air than during idling speed control. Therefore, the device is applicable to the automatic FID control, and in addition, a conventional complicated link mechanism becomes unnecessary.

As described above, at the time of turning the throttle grip to a full-closing position to rapid decelerate the engine, if the sub-throttle valve 21 is opened to open the ISC valve 32 in the bypass air path 28A to additionally supply a bypass air to the combustion chamber 9 of the engine 1, an engine brake torque (back torque) can be reduced and a conventional complicated link mechanism becomes unnecessary.

Basically, the sub-throttle valve 21 follows the opening/closing operation of the main throttle valve 19 with some delay. Such a period that the sub-throttle valve 21 is closed while the main throttle valve 19 is opened is very short. Accordingly, in general, if the sub-throttle valve 21 is closed, the main throttle valve 19 is closed, and in other words, the engine 1 is idling in most cases. In this state, if the ISC valve 32 is opened, the bypass air path 28A is kept opened during the idling operation of the engine 1, and a range of available control of the ISC valve 32 is narrowed. To overcome such a drawback, the sub-throttle valve 21 is set to open in conjunction with an opening operation of the sub-throttle valve 21 and to close if the sub-throttle valve 21 is fully closed, and accordingly, a bypass air flow rate can be set to zero and the ISC can be performed with a wider range of control.

In contrast, the ISC valve 32 can be closed in conjunction with a closing operation of the sub-throttle valve 21. In this case, the ISC valve 32 is set to be fully closed if the sub-throttle valve 21 is fully opened. Thus, similar idling speed control can be executed.

In either of the above cases, even if any failure occurs in the position sensor of the sub-throttle valve 21 or the electric motor 20, the sub-throttle valve 21 is kept full-opened by means of a biasing force of a preload coil spring. However, if the ISC valve 32 is set to be fully closed when the sub-throttle valve 21 is fully opened, the ISC valve 32 is fully closed when the sub-throttle valve 21 is kept full-opened due to any failure. Thus, the bypass air may be shut off to reduce an intake.

On the other hand, the bypass air inlet 29 formed in the wall of the throttle body 12A on the upstream side of the sub-throttle valve 21 of the intake air path 22 is connected to the bypass air outlet 30 formed in the wall of the throttle body 12A on the downstream side of the main throttle valve 19 by way of the bypass air path 28A, and in addition, the ISC valve 32 and the sub-valve shaft 24 are coaxially arranged to allow the ISC valve 32 to be opened or closed in conjunction with the opening/closing operations of the sub-throttle valve 21. As a result, the sub-throttle valve 21 and the ISC valve 32 can be opened or closed in conjunction with each other without using any complicated link mechanism. Thus, responsibility can be increased, and variations among the units of the link mechanism due to tolerances can be reduced. Further, the bypass air path 28A can be formed integrally with the throttle body 12A with no complicated piping.

Further, the sub-valve shaft 24 crossing the bypass air path 28A is deformed to form the ISC valve 32 integrally with the sub-valve shaft 24, and the bypass air path 28A can be closed when the sub-throttle valve 21 is opened at predetermined openings. Thus, it is unnecessary to separately provide the ISC valve 32 with a butterfly valve etc. and the ISC valve 32 and the bypass air path 28A can be downsized.

Moreover, the bypass air path 28A is arranged not to overlap the main valve shaft 23A as viewed from the axial direction of the sub-valve shaft 24. The bypass air path 28A is arranged so as to be set obliquely to cross the axial line 31 of the intake air path 22 not to overlap the main valve shaft 23A. As a result, it is unnecessary to perform any special processing such as forming a through-hole in the main valve shaft 23A.

It is preferable to form the bypass air path 28A so as not to cross the main valve shaft 23A for the above reason, but the bypass air path 28A may be arranged so as to cross the main valve shaft 23A (see the second embodiment as shown in FIGS. 11 to 14). In this case, the through-hole 35 communicating with upstream and downstream side of the main valve shaft 23B is formed in the main valve shaft 23B to prevent the main valve shaft 23B from blocking the opening of the bypass air path 28B.

Further, a bypass air needs to be supplied only when the main throttle valve 19 is almost full-closed. Therefore, the position of the through-hole 35 is determined to open the bypass air path 28B in this state. At this time, if the through-hole 35 has a large diameter, a bypass air flows even if the main throttle valve 19 is not fully closed (the main throttle valve 19 is slightly opened). Accordingly, the small-diameter through-hole 35 is used and in addition, a throttle valve 39 is provided in the bypass air path 28B on the upstream side of the main valve shaft 23B.

As described above, if the main valve shaft 23B and the bypass air path 28B are arranged to cross each other, the bypass air path 28B can extend in parallel with the axial line 31 of the intake air path 22, and the processability will be increased.

On the other hand, as for the throttle bodies 12G, . . . , which include plural intake air paths 22 as in a multicylinder engine, one bypass air path (28G, . . . ) communicates with each of the plural intake air paths 22. Thus, the intake air paths 22 can share a bypass air path, and the widths of the throttle bodies 12G, . . . can be reduced. As a result, the throttle bodies 12G, . . . can be downsized and reduced in size and weight.

Further, in the case of providing the plural bypass air paths (28G, . . . ) and the plural ISC valves 32, it is difficult to control flow rates of bypass air in the plural bypass air paths (28G, . . . ) in synchronism with each other, and the idling speed of the engine could not be stabilized. However, if one bypass air path (28G, . . . ) is shared among the intake air paths 22 in the throttle bodies 12G, . . . , the idling speed can be stabilized.

Finally, according to the present invention, it is possible to realize the air quantity optimum to the FID control of the opening of the sub-throttle valve 21 optimum to the ISC, and the optimum air flow rate characteristics irrespective of an exhaust amount of the engine 1, based on the capacity of the bypass air path 28; or the shape of the sub-valve shaft 24.

What is claimed is:

1. An intake control device for a vehicle engine, comprising:

a throttle body;

a main throttle valve configured to be opened or closed in response to an operation applied to a throttle grip, the main throttle valve being rotatably supported by the throttle body;

a sub-throttle valve configured to be opened or closed under control of an actuator, the sub-throttle valve being rotatably supported by the throttle body;

an intake air path formed in the throttle body and provided with the main throttle valve and the sub-throttle valve so as to open or close the intake air path; and a bypass air path that is different from the intake air path and provided with an idle speed control (ISC) valve that is controlled so as to open or close the bypass air path in conjunction with the sub-throttle valve.

2. The intake control device for a vehicle engine according to claim 1, wherein the ISC valve rotates in an opening direction thereof in conjunction with an opening operation of the sub-throttle valve.

3. The intake control device for a vehicle engine according to claim 2, wherein the ISC valve is fully closed when the sub-throttle valve is fully closed.

4. The intake control device for a vehicle engine according to claim 1, wherein the ISC valve rotates in a closing direction thereof in conjunction with an opening operation of the sub-throttle valve.

5. The intake control device for a vehicle engine according to claim 4, wherein the ISC valve is fully closed when the sub-throttle valve is fully opened.

6. The intake control device for a vehicle engine according to claim 1, wherein the bypass air path communicates with an upstream side of the sub-throttle valve and a downstream side of the main throttle valve in the intake air path, and the ISC valve is rotatably and pivotally supported coaxially with a sub-valve shaft on which the sub-throttle valve is rotatably and pivotally mounted.

7. The intake control device for a vehicle engine according to claim 6, wherein the bypass air path is provided in a manner offset from a main valve shaft on which the main throttle valve is pivotally supported, as viewed from an axial direction of the sub-valve shaft.

8. The intake control device for a vehicle engine according to claim 6, wherein a main valve shaft, on which the main throttle valve is pivotally supported, crosses the bypass air path, and a through-hole is formed in the main valve shaft to communicate with upstream and downstream sides of the bypass air path with a position of the through-hole being determined such that the bypass air path communicates therewith only at substantially opening at which the main throttle valve is fully closed.

9. The intake control device for a vehicle engine according to claim 1, wherein at least a predetermined portion of the sub-valve shaft in the bypass air path is deformed to constitute the ISC valve, and a sub-valve shaft is formed so as to close the bypass air path when the sub-throttle valve is opened at predetermined opening.

10. The intake control device for a vehicle engine according to claim 9, wherein the bypass air path is provided in a manner offset from a main valve shaft on which the main throttle valve is pivotally supported, as viewed from an axial direction of the sub-valve shaft.

11. The intake control device for a vehicle engine according to claim 9, wherein a main valve shaft, on which the main throttle valve is pivotally supported, crosses the bypass air path, and a through-hole is formed in the main valve shaft to communicate with upstream and downstream sides of the bypass air path with a position of the through-hole being determined such that the bypass air path communicates therewith only at substantially opening at which the main throttle valve is fully closed.

12. The intake control device for a vehicle engine according to claim 1, wherein the throttle body includes a plurality of intake air paths and a common bypass air path that communicates with each of the plurality of intake air paths.

13. An intake control device for a vehicle engine, comprising:

a throttle body;

a main throttle valve configured to be opened or closed in response to an operation applied to a throttle grip, the main throttle valve being rotatably supported by the throttle body;

a sub-throttle valve configured to be opened or closed under control of an actuator, the sub-throttle valve being rotatably supported by the throttle body;

an intake air path formed in the throttle body and provided with the main throttle valve and the sub-throttle valve so as to open or close the intake air path; and a bypass air path that is different from the intake air path and provided with an idle speed control (ISC) valve that is controlled so as to open or close the bypass air path in conjunction with the sub-throttle valve by opening or closing the sub-throttle valve under control of the actuator when the main throttle valve is fully closed.

14. The intake control device for a vehicle engine according to claim 13, wherein the throttle body includes a plurality of intake air paths and a common bypass air path that communicates with each of the plurality of intake air paths.

* * * * *